US006472819B2

(12) United States Patent
Carretti et al.

(10) Patent No.: US 6,472,819 B2
(45) **Date of Patent: *Oct. 29, 2002**

(54) NONEVAPORABLE GETTER SYSTEM FOR PLASMA FLAT PANEL DISPLAY

(75) Inventors: Corrado Carretti, Milan; Roberto M. Caloi, Opera; Marco Amiotti, Vigevano, all of (IT)

(73) Assignee: Saes Getters S.p.A., Viale (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 69 days.

(21) Appl. No.: 09/167,833

(22) Filed: Oct. 7, 1998

(65) Prior Publication Data

US 2002/0008469 A1 Jan. 24, 2002

(30) Foreign Application Priority Data

Oct. 20, 1997 (IT) ..... MI97A2362

(51) Int. Cl.[7] ..... H01J 17/24
(52) U.S. Cl. ..... 313/562; 313/553; 313/582
(58) Field of Search ..... 313/562, 553, 313/549, 582, 583, 584, 585, 586, 587, 559, 558; 445/24, 41

(56) References Cited

U.S. PATENT DOCUMENTS

| | | | | |
|---|---|---|---|---|
| 3,800,178 A | | 3/1974 | Farina | |
| 5,242,559 A | | 9/1993 | Giorgi | |
| 5,663,611 A | * | 9/1997 | Seats et al. | 313/584 |
| 5,667,418 A | | 9/1997 | Fahlen et al. | |
| 5,894,193 A | * | 4/1999 | Amrine et al. | 313/495 |
| 6,033,278 A | * | 3/2000 | Watkins et al. | 445/41 |
| 6,139,390 A | * | 10/2000 | Pothoven et al. | 445/24 |
| 6,194,830 B1 | * | 2/2001 | Cho et al. | 313/495 |

FOREIGN PATENT DOCUMENTS

| | | |
|---|---|---|
| JP | 63237338 | 10/1988 |
| JP | 5-342991 | 12/1993 |
| JP | 09199009 | 7/1997 |
| WO | WO 95/23425 | 8/1995 |
| WO | WO 98/03987 | 1/1998 |

OTHER PUBLICATIONS

W.E. Ahearn et al., "*Effect of Reactive Gas Dopants on the MgO Surface in AC Plasma Display Panel*," IBM J. Res. Dev., vol. 22, No. 6, Nov. 1978, pp. 622–625.

* cited by examiner

*Primary Examiner*—Ashok Patel
*Assistant Examiner*—Karabi Guharay
(74) *Attorney, Agent, or Firm*—Perkins Coie LLP; David B. Dort; Paul Hickman

(57) ABSTRACT

A getter system for plasma flat panel displays is disclosed. In a plasma flat panel display having front and rear panels sealingly joined together at peripheral edges thereof to define an inner space and a plurality of walls disposed within the inner space, the walls defining a series of substantially parallel secondary channels with openings at first and second ends thereof and a main channel extending along the perimeter of the front and rear panels, the getter system includes at least one nonevaporable getter device disposed within the inner space. The at least one nonevaporable getter device may be located in a portion of the main channel that faces the openings at one of the first and second ends of the secondary channels.

35 Claims, 5 Drawing Sheets

NONEVAPORABLE GETTER SYSTEM FOR PLASMA FLAT PANEL DISPLAY

CLAIM FOR PRIORITY

This patent application claims priority under 35 U.S.C. § 119 from Italian Patent Application No. M197 A 002362, filed Oct. 20, 1997, which is incorporated herein by reference for all purposes.

BACKGROUND OF THE INVENTION

The present invention relates generally to plasma flat panel displays and, more particularly, to a getter system for plasma flat panel displays.

Plasma flat panel displays, which are sometimes referred to as "plasma display panels" or "PDP," have long been studied as potential replacements for the cathode ray tube (CRT) displays presently used in devices such as televisions and computer monitors. It is expected that commercial products incorporating plasma flat panel displays will be brought to market in the near future.

A plasma flat panel display includes front and rear glass panels that are sealingly joined together along their peripheral edges with a low-melting point glass paste. A number of functional components, e.g., electrodes and phosphors, are provided in the inner space between the front and rear glass panels, which is filled with a mixture of rare gases. The principle of operation of a plasma flat panel display is the conversion of ultraviolet radiation into visible light by phosphors. The ultraviolet radiation is generated in the rare gas mixture when an electrical discharge is produced therein. Thus, to use a plasma flat panel display as a screen for a television or a computer monitor, it is apparent that a plurality of extremely small light sources is needed to form a suitable image. To satisfy this requirement, a plurality of electrode pairs for generating localized electrical discharges is provided in the inner space between the front and rear glass panels. The electrical discharges generated by the electrode pairs are confined within a small area by not only applying a potential difference to a predetermined pair of single electrodes, but also dividing the inner space between the front and rear glass panels into a series of microspaces, e.g., parallel channels having a width of about 0.1–0.3 mm.

FIGS. 1 and 2 illustrate the configurations used to define microspaces in two known plasma flat panel displays. As shown in FIG. 1, plasma flat panel display 10 includes front glass panel 11 and rear glass panel 12. Front glass panel 11 carries a first series of electrodes 13 (indicated by the dashed lines) and rear glass panel 12 carries a second series of electrodes 14. Walls 15 define a plurality of parallel channels 16, each of which has one of electrodes 14 located therein. The second series of electrodes 14 is orthogonal to the first series of electrodes 13. Referring to FIG. 2, in plasma flat panel display 20 a plurality of cell structures 21 divide the space between front glass panel 11 and rear glass panel 12 into small cells having a side dimension of, e.g., 0.1–0.3 mm. The cell structures 21 also define a plurality of parallel channels 16. As shown in FIG. 2, the second series of electrodes 14 is oriented so that the electrodes pass through channels 16, i.e., the electrodes are perpendicular to the direction of channels 16. In plasma flat panel display 20 the first series of electrodes 13, which is not shown in FIG. 2, is orthogonal to the second series of electrodes 14.

The structures that define the microspaces, e.g., simple walls as shown in FIG. 1 or more complex cell structures as shown in FIG. 2, extend over the entire surface of the front and rear glass panels, except for an edge area at the perimeter of the panels. In operation an image is formed on the front glass panel in an image-forming area, which corresponds with the area over which the microspace-defining structures extend. The edge area, which is typically 2–15 mm wide depending on the dimensions of the plasma flat panel display, defines a channel that has a high gas conductance and therefore serves as the primary gas conductance within the inner space between the front and rear glass panels. The channels defined in the image-forming area have a much lower gas conductance than the channel in the edge area and therefore serve as secondary gas conductance sources.

The rare gas mixture used to fill the inner space between the front and rear gas panels generally consists of helium and neon with minor amounts of xenon or argon. To ensure proper operation of a plasma flat panel display, the chemical composition of the rare gas mixture in which the plasma is formed must remain constant. If traces of atmospheric gases such as nitrogen, oxygen, water, or carbon oxides enter the rare gas mixture, then changes in the electrical operating parameters of the plasma flat panel display occur, as disclosed in the publication by W. E. Ahearn and O. Sahni, "Effect of reactive gas dopants on the MgO surface in AC plasma display panels," IBM J. Res. Dev., Vol. 22, No. 6, November 1978, pp. 622–625. In the manufacturing of plasma flat panel displays, after the front and rear glass panels have been joined together, atmospheric gases are evacuated from the inner space by means of a pump connected to the inner space by means of a tiny hole formed at a corner of one of the panels at a position corresponding to the edge area. The rate at which the atmospheric gases can be evacuated from the inner space is limited because all the gas in the channels defined in the image-forming area flows into the channel at the edge area, thus creating an accumulation of gas that cannot be quickly removed. The pressure variation in the various areas of the inner space has not been studied in depth and, consequently, plasma flat panel display manufacturers use empirically determined evacuation times of several hours as a compromise between the conflicting demands of minimizing production time (and costs) and obtaining low residual pressures of atmospheric gases required for proper operation of the display. Another source of impurities in the inner space is the degassing of the materials disposed therein, e.g., the phosphors, caused by the heating and electronic bombardment that occurs during operation of the display.

Japanese Patent Publication No. 5-342991 discloses method of removing impurities from the inner space during the manufacturing of a plasma flat panel display. In this method a deposit of porous magnesium oxide, MgO, is provided along an edge of the display, with the ends of the deposit being connected to a source of direct current. When a voltage is applied, the MgO deposit is capable of sorbing certain impurities, e.g., water and carbon dioxide, from the inner space. Once the manufacturing process is finished, however, the electrical contacts are removed and the MgO deposit loses its ability to sorb impurities. Consequently, the MgO deposit does not sorb the gaseous impurities generated by the degassing of the components disposed within the inner space. Thus, this method does not provide a solution to the degassing problem, which causes the gaseous impurity concentration within the inner space to increase over the course of the display's service life.

In view of the foregoing, there is a need for an improved process of evacuating the inner space of plasma flat panel displays during manufacturing that reduces evacuation time.

There is also a need for a mechanism for sorbing gaseous impurities that are generated within the inner space during the display's service life.

SUMMARY OF THE INVENTION

Broadly speaking, the invention fills this need by providing a getter system for use in plasma flat panel displays. The getter system includes one or more nonevaporable getter devices that are configured so that they do not significantly reduce the gas conductance within the inner space defined by the front and rear panels of the display.

In one aspect of the invention, a getter system for use in a plasma flat panel display is provided. The plasma flat panel display preferably has front and rear panels sealingly joined together at peripheral edges thereof to define an inner space and a plurality of walls disposed within the inner space. These walls define a series of substantially parallel secondary channels with openings at first and second ends thereof and a main channel extending along the perimeter of the front and rear panels. The getter system includes at least one nonevaporable getter device disposed within the inner space. The at least one nonevaporable getter device is preferably located in a portion of the main channel that faces the openings at one of the first and second ends of the secondary channels.

In one embodiment the getter system includes first and second nonevaporable getter devices disposed within the inner space. The first nonevaporable getter device is located in a portion of the main channel that faces the openings at the first end of the secondary channels and the second nonevaporable getter device is located in a portion of the main channel that faces the openings at the second end of the secondary channels.

In one embodiment the at least one nonevaporable getter device is a deposit comprised of powdered nonevaporable getter material. The deposit preferably continuously covers the portion of the main channel that faces the openings at one of the first and second ends of the secondary channels and has a thickness not greater than about half of the height of the main channel. The deposit may be formed directly on one of the front and rear panels. Alternatively, the deposit may be formed on a support member, e.g., metal tape.

In another embodiment the nonevaporable getter device is at least one pellet comprised of sintered powder of a nonevaporable getter material. The at least one pellet is preferably disposed in a seat formed in an inner surface of one or both of the front and rear panels.

The at least one nonevaporable getter device may be formed of a variety of nonevaporable getter materials. Suitable nonevaporable getter materials include but, are not limited to, titanium, zirconium, titanium alloys containing a transition metal or aluminum, zirconium alloys containing a transition metal or aluminum, a mixture of titanium and a titanium alloy containing a transition metal or aluminum, and a mixture of zirconium and a zirconium alloy containing a transition metal or aluminum. The nonevaporable getter material is preferably in powder form having a particle size smaller than about 0.15 mm. Depending on the technique used to form the nonevaporable getter device, it may be desirable to use nonevaporable getter material powder having a particle size smaller than about 128 $\mu$m or even smaller than about 60 $\mu$m.

Preferred nonevaporable getter materials include an alloy containing 70 wt % of Zr, 24.6 wt % of V, and 5.4 wt % of Fe, an alloy containing 84 wt % of Zr and 16 wt % of Al, an alloy containing 76.5 wt % of Zr and 23.5 wt % of Fe, an alloy containing 76 wt % of Zr and 24 wt % of Ni, and a mixture containing 60 wt % of the alloy containing 70 wt % of Zr, 24.6 wt % of V, and 5.4 wt % of Fe and 40 wt % of zirconium.

In another aspect of the invention, a plasma flat panel display is provided. The plasma flat panel display includes a front panel, a rear panel, and a plurality of walls disposed between and in a center region of the front and rear panels. The walls define a plurality of secondary channels in the center region of the front and rear panels and a main channel along an internal periphery of the front and rear panels. A nonevaporable getter device is disposed within the main channel.

In one embodiment the front and rear panels are sealingly joined together at peripheral edges thereof, and an inner surface of each of the front and rear panels carries a series of electrodes. The series of electrodes carried by the inner surface of the front panel is orthogonal to the series of electrodes carried by the inner surface of the rear panel. In this embodiment the center region of the front panel defines a display area, and the walls extend substantially throughout the center region, with the main channel being adjacent to a periphery of the center region. The secondary channels have openings at each end thereof, and the nonevaporable getter device is preferably disposed within an area of the main channel that faces the openings at one end of the secondary channels.

If desired, first and second nonevaporable getter devices may be disposed within the main channel. The first nonevaporable getter device is preferably located within an area of the main channel that faces the openings at one end of the secondary channels and the second nonevaporable getter device is preferably located within an area of the main channel that faces the openings at the other end of the secondary channels.

As described above, the at least one nonevaporable getter device may be either a deposit comprised of powdered nonevaporable getter material or a pellet comprised of sintered powder of a nonevaporable getter material. When the nonevaporable getter device is in the form of a deposit, the deposit preferably continuously covers the area of the main channel that faces the openings at one end of the secondary channels and has a thickness not greater than about half of the height of the main channel. The deposit may be formed directly on one of the front and rear panels or on a support member, e.g., metal tape. When the nonevaporable getter device is in the form of a pellet, the pellet is preferably disposed in a seat formed in an inner surface of one or both of the front and rear panels. Whether in the form of a deposit or a pellet, the nonevaporable getter device may be formed from the nonevaporable getter materials described above.

The getter system of the present invention provides significant advantages during both the manufacturing and the service life of a plasma flat panel display. During manufacturing, the getter system acts as an additional pump in the main channel of the plasma flat panel display. This prevents the problems associated with gas discharge through the main channel and enables lower residual pressures to be obtained within the inner space of the plasma flat panel display, thereby reducing the pumping time required to evacuate the inner space. Over the course of the service life of the plasma flat panel display, the getter system of the invention provides constant pumping action that continuously removes the gaseous impurities generated by degassing of the materials from which the components of the display are formed. This ensures proper operation of the display by keeping the composition of the rare gas mixture within the inner space constant.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE PREFERRED EMBODIMENTS

Figure 1:
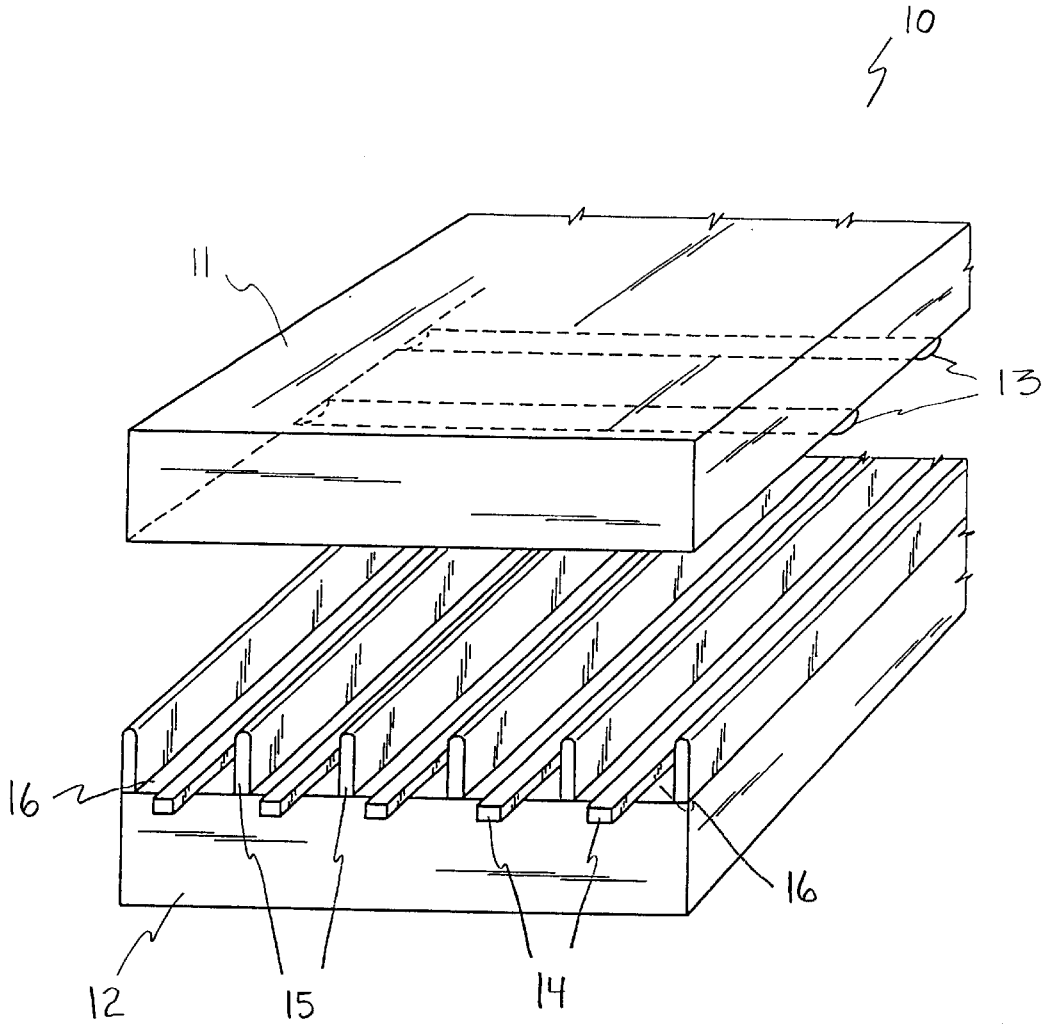
Fig. 1 PRIOR ART
FIG. 1 shows a prior art plasma flat panel display in which channels are defined in the inner space between the front and rear panels by a plurality of walls.
Figure 2:
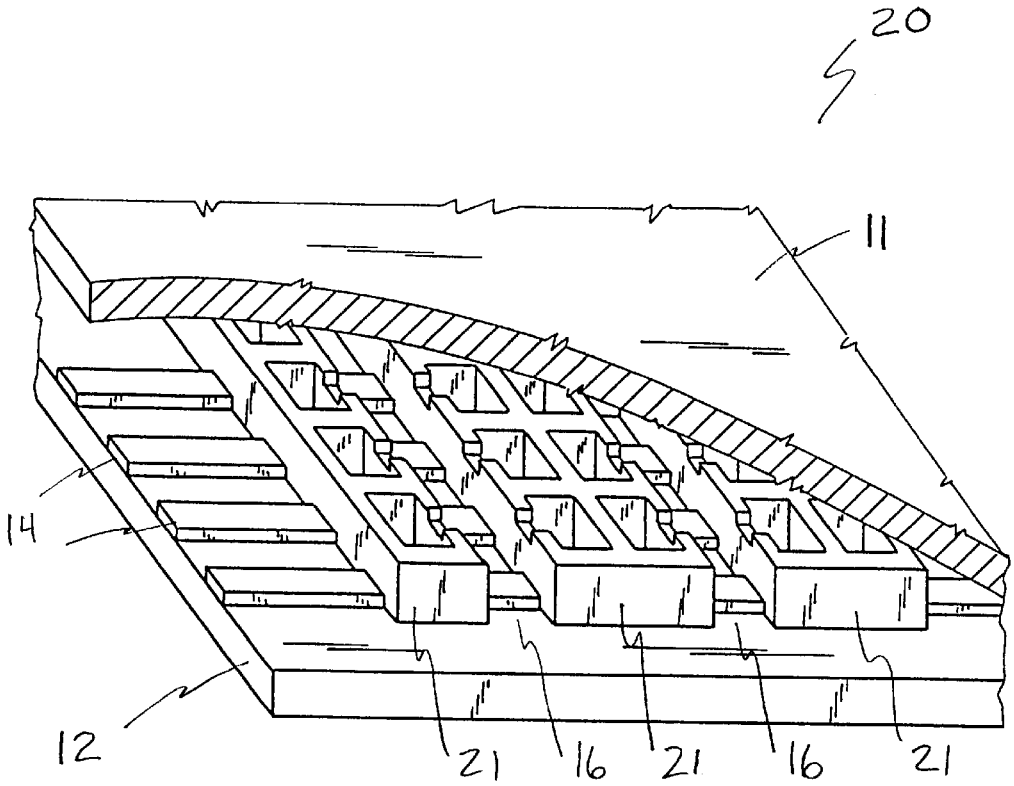
Fig. 2 PRIOR ART
FIG. 2 shows a prior art plasma flat panel display in which channels are defined in the inner space between the front and rear panels by a plurality of cell structures.

Reference will now be made to the present preferred embodiments of the invention, examples of which are illustrated in the accompanying drawings. FIGS. 1 and 2 are discussed above in the "Background of the Invention" section.

In the following description the present invention will be described with reference to a plasma flat panel display having an internal configuration including channels defined by simple walls as illustrated in FIG. 1. Those skilled in the art will appreciate that the principles of the present invention are also applicable in plasma flat panel displays having an internal configuration including channels defined by other structures, e.g., the cell structures illustrated in FIG. 2, because, for the problems addressed by the present invention, such displays are substantially equivalent to displays having channels defined by simple walls.

Figure 3A:
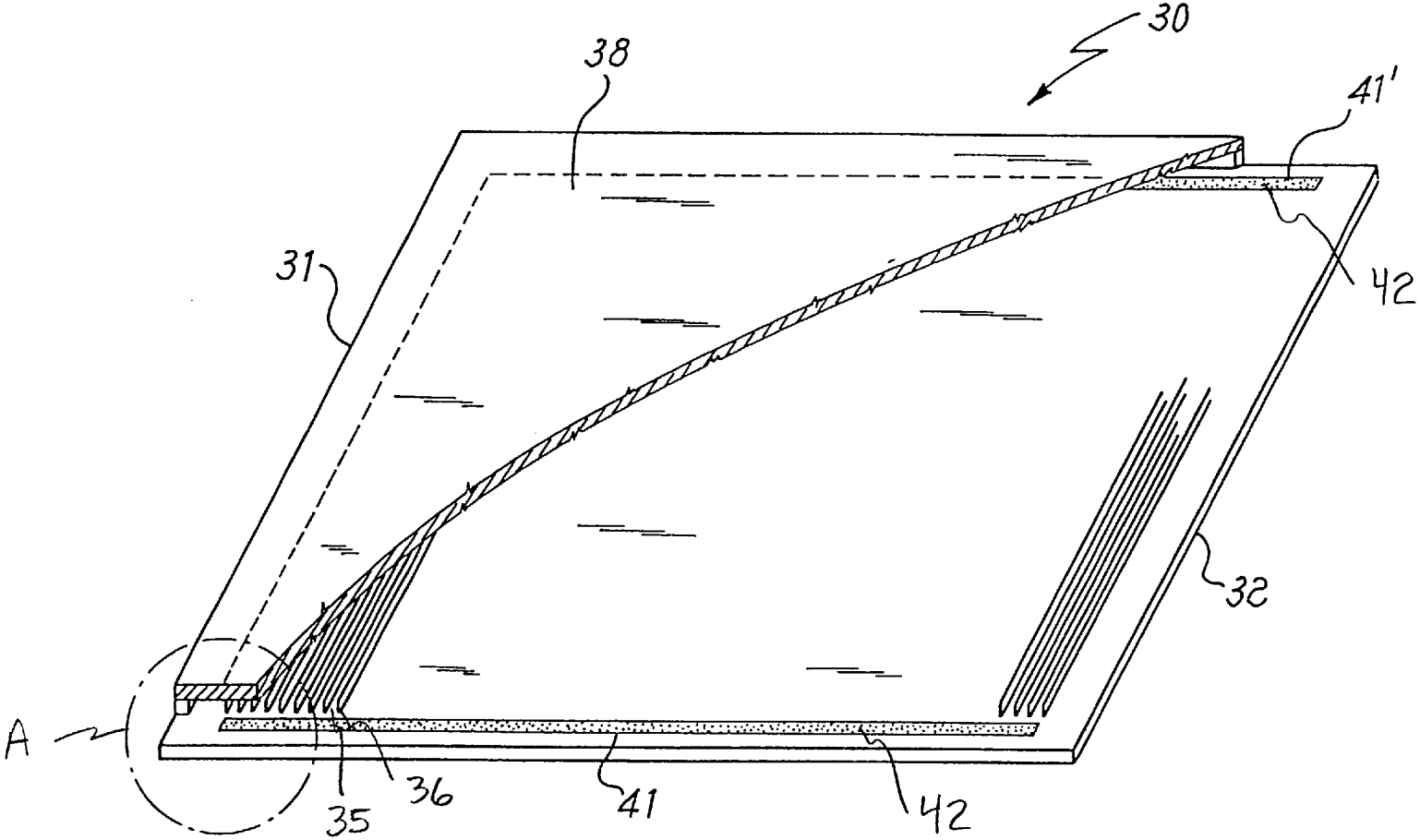
FIG. 3*a* is a partially cutaway view of a plasma flat panel display provided with a getter system in accordance with one embodiment of the invention.
Figure 3B:
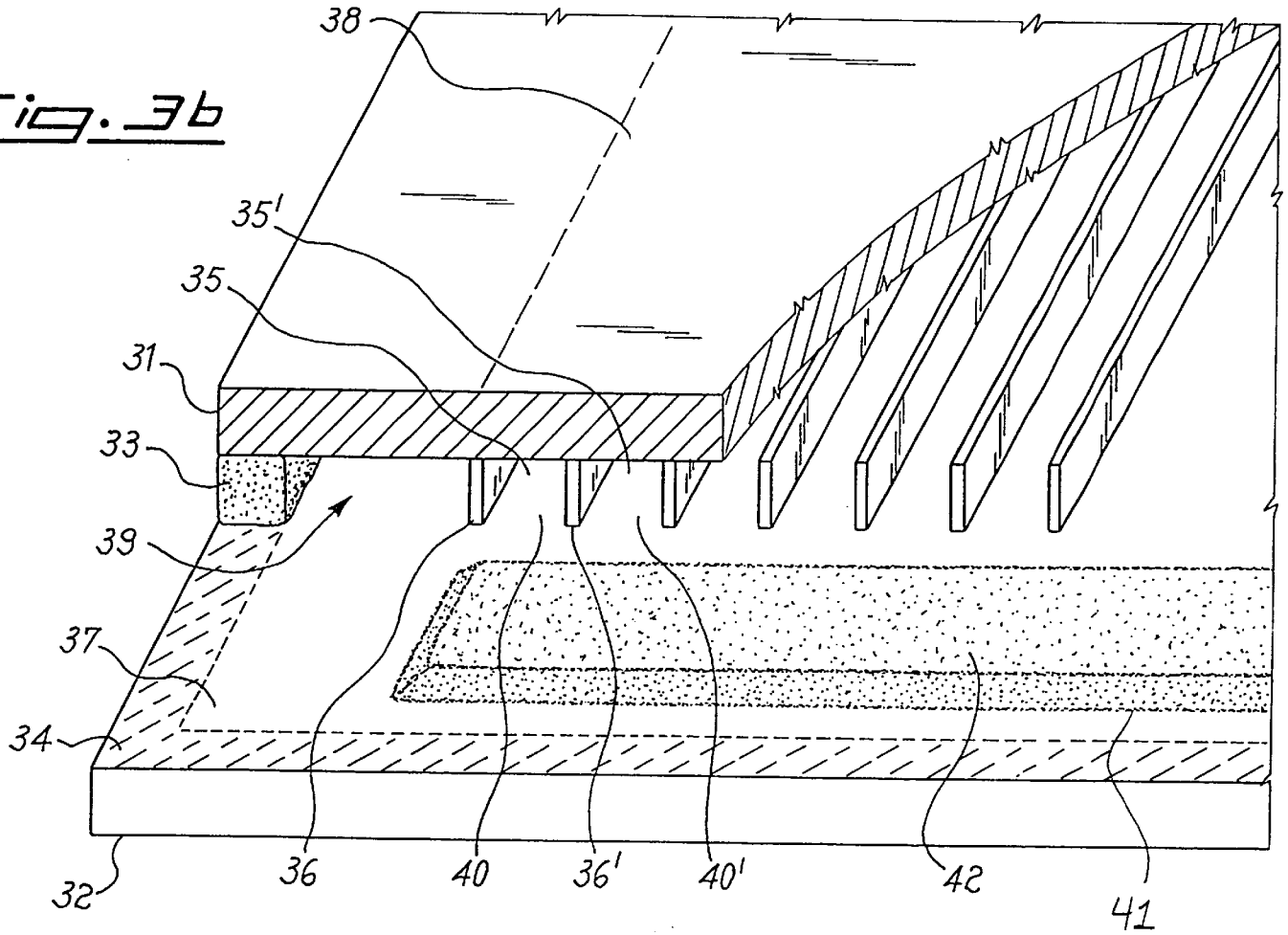
FIG. 3*b* shows an enlarged view of region A indicated by the dashed circle in FIG. 3*a*.

FIGS. 3*a* and 3*b* show a plasma flat panel display including a getter system in accordance with one embodiment of the invention. Those skilled in the art will appreciate that certain components of the plasma flat panel display that are not required for a full understanding of the invention, e.g., the deposits of electroconductive materials forming the electrodes and the phosphors, are not shown in FIGS. 3*a* and 3*b*. As shown in FIG. 3*a*, plasma flat panel display 30 includes front glass panel 31 and rear glass panel 32. FIG. 3*b* shows an enlarged view of region A indicated by the dashed circle in FIG. 3*a*. As shown in FIG. 3*b*, front glass panel 31 and rear glass panel 32 are sealingly joined together by low-melting point glass paste 33 placed in perimetrical area 34. Within the inner space defined by front glass panel 31 and rear glass panel 32 a plurality of secondary channels 35 are defined by walls 36. The multi-channeled structure defined by walls 36 extends over substantially all of panels 31 and 32, with the exception of edge area 37, and defines image-forming area 38 of front glass panel 31. The portion of the inner space that is not occupied by the multi-channeled structure, which is at a location corresponding to edge area 37, forms main channel 39. The width of main channel 39 corresponds to the width of edge area 37, which, as mentioned above, is generally in a range from about 2 mm and about 15 mm. The height of main channel 39 corresponds to the distance between the inner surfaces of front glass panel 31 and rear glass panel 32, and generally is in a range from about 0.2 mm to about 0.3 mm. The upper and lower surfaces of walls 36 contact front glass panel 31 and rear glass panel 32, respectively, such that the space within each of secondary channels 35 communicates with the rest of the inner space only through openings 40 at the ends of each of secondary channels 35.

In accordance with the invention, a getter system including at least one nonevaporable getter device is provided within the inner space of the plasma flat panel display. With reference to FIG. 3*a*, nonevaporable getter devices 42 forming the getter system are arranged in areas 41, 41' adjacent to the sides of plasma flat panel display 30 that are perpendicular to the direction in which secondary channels 35 extend. If desired, a nonevaporable getter device may be provided in only one of areas 41, 41'. As shown in FIG. 3*b*, nonevaporable getter device 42 completely fills up area 41 (shown in FIG. 3*a*). Alternatively, the nonevaporable getter device or devices may occupy only a portion of areas 41, 41', as will be described in detail below. Area 41 in which nonevaporable getter device 42 is disposed corresponds to the portion of main channel 39 that faces openings 40 at one end of secondary channels 35. As shown in FIG. 3*b*, nonevaporable getter device 42 is in the form of a deposit of nonevaporable getter material powder formed directly on the inner surface of rear glass panel 32. Those skilled in the art will recognize that nonevaporable getter device 42 also may be in the form of a deposit formed on an additional support, e.g., metal tape. Those skilled in the art will further recognize that nonevaporable getter device 42 also may be formed directly on the inner surface of front glass panel 31.

The nonevaporable getter device or devices of the getter system of the invention may physically contact one or both of front glass panel 31 and rear glass panel 32. Irrespective of which of panels 31 and 32 the nonevaporable getter device or devices physically contact, however, the configuration of the nonevaporable getter device or devices, as well as the configuration of the getter system as a whole, must not significantly reduce the gas conductance of main channel 39. In the case where the nonevaporable getter device or devices physically contact only one of panels 31 and 32, this requirement may be complied with in one of two ways. The first way is to have the nonevaporable getter device or devices only partially fill one or both of areas 41, 41'. The second way, which applies when a nonevaporable getter device completely fills one or both of areas 41, 41', is to limit the thickness of the nonevaporable getter device. As shown in FIG. 3*b*, the thickness of nonevaporable getter device 42 is approximately one-half of the height of main channel 39. In the case where the nonevaporable getter devices physically contact both of panels 31 and 32, this requirement may be complied with by arranging the nonevaporable getter devices so that they are spaced apart from one another, as will be described in more detail below.

Figure 4:
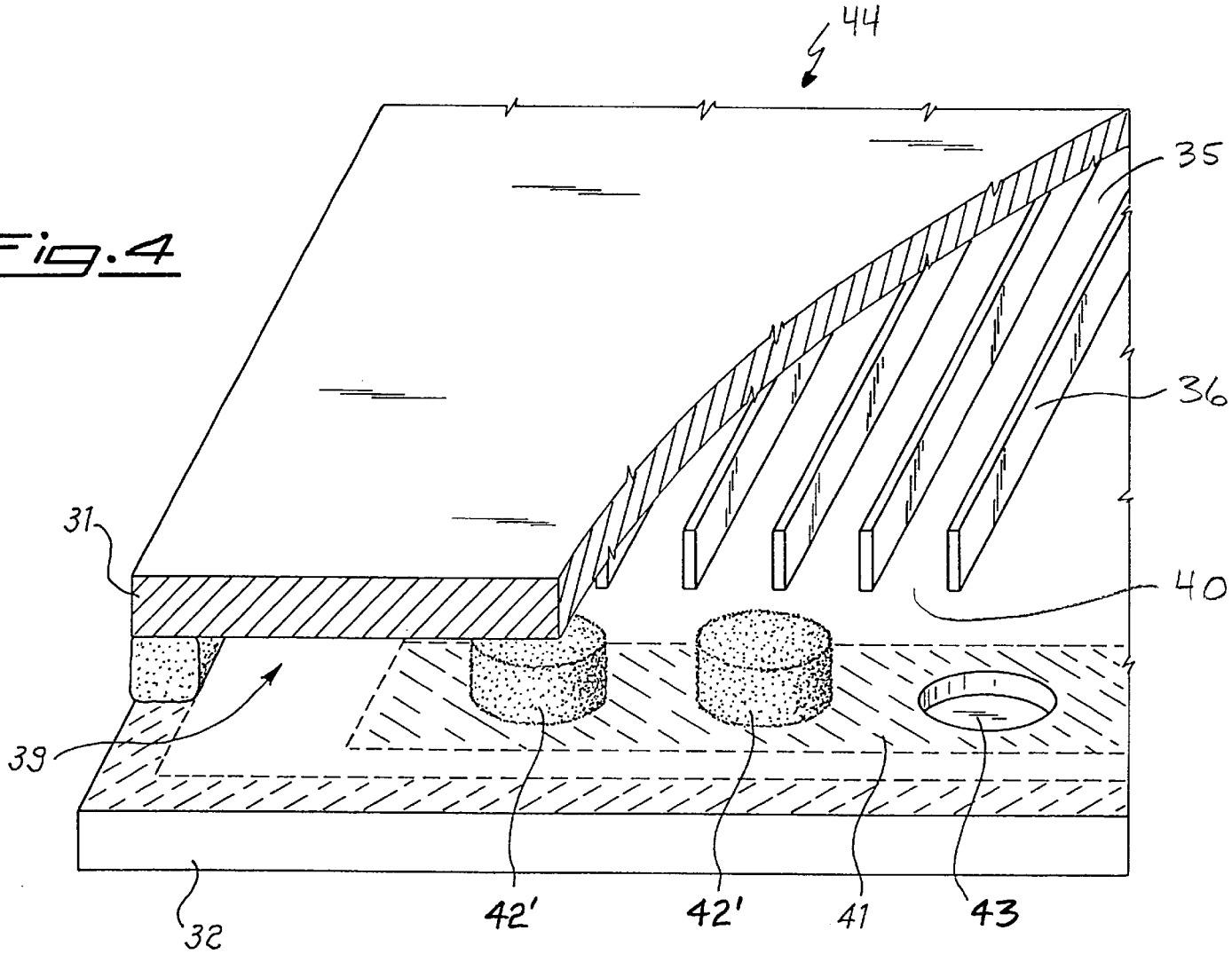
FIG. 4 shows an enlarged view of a region of a plasma flat panel display including a getter system in accordance with another embodiment of the invention. The region of the plasma flat panel display shown in FIG. 4 corresponds to region A indicated by the dashed circle in FIG. 3*a*.

FIG. 4 shows a plasma flat panel display including a getter system in accordance with another embodiment of the invention. As shown in FIG. 4, plasma flat panel display 44 is provided with a getter system including a number of nonevaporable getter devices 42' in the form of pellets. Nonevaporable getter devices 42' physically contact the inner surfaces of both front glass panel 31 and rear glass panel 32 and are located in area 41 in a spaced apart relationship with one another. To ensure accurate and reliable positioning, nonevaporable getter devices 42' may be disposed in seats 43 formed in the inner surface of one or both of panels 31 and 32. By providing seats in the inner surfaces of both the front and rear panels, the thickness of the pellets and hence the amount of nonevaporable getter material within the inner space may be increased. Alternatively, in the case of pellets having a thickness corresponding to the distance between the front and rear panels, the use of seats increases the gas conductance in main channel 39.

Those skilled in the art are familiar with suitable techniques for forming the nonevaporable getter devices shown in FIGS. 3*b* and 4. For example, a supported nonevaporable getter device such as device 42 shown in FIG. 3*b* may be formed by screen printing nonevaporable getter material powder directly on rear glass panel 32. A non-supported nonevaporable getter device such as device 42' in the form of a pellet shown in FIG. 4 may be formed by compressing nonevaporable getter material powder in a suitable mold to form a pellet compact and then sintering the pellet compact to bond the powder particles.

In the screen printing process used to form nonevaporable getter device 42 shown in FIG. 3*b*, a wet paste comprised of the nonevaporable getter material powder and a suspending means for maintaining the fluidity of the paste is deposited using screens, which are generally formed of synthetic fabrics, laid on rear glass panel 32. By selectively blocking some of the openings in the screen mesh, a localized wet deposit having a desired geometry may be obtained. Once the wet deposit is obtained, it is first dried in air or an oven to remove the volatile components in the paste and then subjected to a thermal treatment at a high temperature, e.g., about 700° C. to about 1,000° C., to bond the nonevaporable getter material powder. Further details of the screen printing process, which also may be used to form a deposit of nonevaporable getter material powder on supports formed of materials other than glass, are set forth in International Publication No. WO 98/03987, the disclosure of which is incorporated herein by reference.

In certain situations it may be preferable to form the deposit of nonevaporable getter material powder on an additional support, e.g., metal tape, and then mount the supported deposit on one of the front and rear glass panels. In addition to being formed by the screen printing process described above, a nonevaporable getter device including an additional support may be formed by cold lamination, electrophoresis, or a spray technique. Cold lamination is well known in the field of powder deposits. When this technique is used, the nonevaporable getter material powder preferably has a particle size in the range from about 0.1 mm to about 0.15 mm and the support is preferably in the form of a metal tape of, e.g., nickeled iron or constantan. The details of the electrophoretic technique are set forth in U.S. Pat. No. 5,242,559, the disclosure of which is incorporated herein by reference. The support is preferably formed of an electroconductive material, e.g., metal, when the nonevaporable getter device is formed by the electrophoretic technique. In the spray technique, diluted suspensions of nonevaporable getter material powder are sprayed onto a hot substrate. There are no specific restrictions concerning the material from which the substrate, i.e., support, is formed when this technique is used. Further details of the spray technique are set forth in International Publication No. WO 95/23425, the disclosure of which is incorporated herein by reference. In the case of screen printing on an additional support, the nonevaporable getter device is preferably produced by first depositing the paste on the surface of a sheet of support material, and then cutting strips having the desired dimensions therefrom. The preferred materials for the additional support include nickel, titanium, nickel-chromium alloys, and nickel-chromium-iron alloys.

When the getter system of the invention includes a supported nonevaporable getter device formed directly on one of the front and rear panels or on an additional support, a seat in the form of a groove in one of the panels may be provided for the supported nonevaporable getter device. The use of a seat for the supported nonevaporable getter device is desirable because it minimizes the reduction in the conductance that may occur in main channel 39 and at openings 40 of secondary channels 35.

The nonevaporable getter devices used in the getter system of the invention may be formed of a variety of nonevaporable getter materials. Suitable nonevaporable getter materials include, but are not limited to, titanium, zirconium, titanium alloys containing a transition metal or aluminum, zirconium alloys containing a transition metal or aluminum, a mixture of titanium and a titanium alloy containing a transition metal or aluminum, and a mixture of zirconium and a zirconium alloy containing a transition metal or aluminum. Commercially available nonevaporable getter materials produced by SAES Getters S.p.A. of Lainate, Italy, the assignee of the present application, that are well suited for use in the getter system of the invention include the alloys sold under the trade names St 707™, St 101®, St 198™, St 199™, and St 172™. The St 707™ alloy has a composition of 70 wt % Zr, 24.6 wt % V, and 5.4 wt % Fe. The St 101® alloy has a composition of 84 wt % Zr and 16 wt % Al. The St 198™ alloy has a composition of 76.5 wt % Zr and 23.5 wt % Fe. The St 199™ alloy has a composition of 76 wt % Zr and 24 wt % Ni. The St 172™ alloy contains 60 wt % of the St 707™ alloy and 40 wt % of zirconium. When applied by cold lamination onto a support, these alloys are preferably used in the form of powders having a particle size ranging from about 0.1 mm to about 0.15 mm. When used with other application techniques, these alloys are preferably used in the form of powders having a particle size smaller than about 128 $\mu$m, and more preferably smaller than about 60 $\mu$m. To adequately perform their sorbing function, these alloys require a thermal activation treatment at a temperature in the range from about 350° C., to about 450° C. The activation may be carried out during the operation in which the front and rear glass panels are joined together using low-melting point paste because temperatures of about 400° C. to about 500° C. are reached during this operation to melt the paste. Alternatively, the activation operation may be carried out in a subsequent thermal treatment.

The getter system of the present invention provides at least two significant technical advantages. First, during manufacturing of the plasma flat panel display, the getter system acts as an additional pump in the main channel of the display. This prevents the problems associated with gas discharge through the main channel and enables lower residual pressures to be obtained within the inner space of the plasma flat panel display, thereby reducing the pumping time required to evacuate the inner space. Second, over the course of the service life of the plasma flat panel display, the getter system of the invention provides constant pumping action that continuously removes the gaseous impurities generated by degassing of the materials from which the components of the display are formed. This ensures proper operation of the display by keeping the composition of the rare gas mixture within the inner space constant.

In summary, the present invention provides a getter system for use in a plasma flat panel display that enables gaseous impurities to be removed from the inner space, during manufacturing of the display as well as over the course of its service life. The invention has been described herein in terms of several preferred embodiments. Other embodiments of the invention will be apparent to those skilled in the art from consideration of the specification and practice of the invention. For example, as mentioned above, the at least one nonevaporable getter device may be disposed on the front panel of the display instead of the rear panel as shown herein. The embodiments and preferred features described above should be considered exemplary, with the invention being defined by the appended claims.

What is claimed is:

1. A plasma flat panel display comprising:

front and rear panels sealingly joined together at peripheral edges thereof to define an inner space filled with a rare gas mixture;

a plurality of walls disposed within said inner space, said walls being coupled between said front and rear panels and defining a series of substantially parallel secondary channels with openings at first and second ends thereof, said plurality of walls not extending to said peripheral edge of said front and rear panels to define a main channel extending along said peripheral edge of said front and rear panels; and at least one nonevaporable getter device disposed within said inner space, said at least one nonevaporable getter device being located only in a portion of said main channel that faces the openings at one of said first and second ends of said secondary channels.

2. The getter system of claim 1, wherein first and second nonevaporable getter devices are disposed within said inner space, said first nonevaporable getter device being located in a portion of said main channel that faces the openings at said first end of said secondary channels and said second nonevaporable getter device being located in a portion of said main channel that faces the openings at said second end of said secondary channels.

3. The getter system of claim 1, wherein the nonevaporable getter device is a deposit comprised of powdered nonevaporable getter material, said deposit continuously covering the portion of the main channel that faces the openings at one of the first and second ends of the secondary channels and having a thickness not greater than about half of the height of the main channel.

4. The getter system of claim 3, wherein the deposit is formed directly on one of the front and rear panels.

5. The getter system of claim 3, wherein the deposit is formed on a support member.

6. The getter system of claim 5, wherein the support member is a metal tape.

7. The getter system of claim 1, wherein the nonevaporable getter device is at least one pellet comprised of sintered powder of a nonevaporable getter material.

8. The getter system of claim 7, wherein the at least one pellet. is disposed in a seat formed in an inner surface of one or both of the front and rear panels.

9. The getter system of claim 1, wherein the nonevaporable getter material is selected from the group consisting of titanium, zirconium, titanium alloys containing a transition metal or aluminum, zirconium alloys containing a transition metal or aluminum, a mixture of titanium and a titanium alloy containing a transition metal or aluminum, and a mixture of zirconium and a zirconium alloy containing a transition metal or aluminum, and the nonevaporable getter material is in powder form having a particle size smaller than about 0.15 mm.

10. The getter system of claim 9, wherein the nonevaporable getter material powder has a particle size smaller than about 128 $\mu$m.

11. The getter system of claim 9, wherein the nonevaporable getter material powder has a particle size smaller than about 60 $\mu$m.

12. The getter system of claim 9, wherein the nonevaporable getter material comprises an alloy containing 70 wt % of Zr, 24.6 wt % of V, and 5.4 wt % of Fe.

13. The getter system of claim 9, wherein the nonevaporable getter material comprises an alloy containing 84 wt % of Zr and 16 wt % of Al.

14. The getter system of claim 9, wherein the nonevaporable getter material comprises an alloy containing 76.5 wt % of Zr and 23.5 wt % of Fe.

15. The getter system of claim 9, wherein the nonevaporable getter material comprises an alloy containing 76 wt % of Zr and 24 wt % of Ni.

16. The getter system of claim 9, wherein the nonevaporable getter material comprises a mixture containing 40 wt % of Zr and 60 wt % of an alloy containing 70 wt % of Zr, 24.6 wt % of V, and 5.4 wt % of Fe.

17. A plasma flat panel display, comprising:

a front panel;

a rear panel;

a plurality of walls disposed between and in a center region of said front and rear panels, said walls defining a plurality of secondary channels in said center region of said front and rear panels and a main channel along an internal periphery of said front and rear panels; and a nonevaporable getter device disposed only within a portion of said main channel.

18. The plasma flat panel display of claim 17, wherein the front and rear panels are sealingly joined together at peripheral edges thereof, and an inner surface of each of said front and rear panels carries a series of electrodes, said series of electrodes being carried by said inner surface of said front panel being orthogonal to said series of electrodes being carried by said inner surface of said rear panel.

19. The plasma flat panel display of claim 17, wherein the center region of said front panel defines a display area, and the walls extend substantially throughout the center region.

20. The plasma flat panel display of claim 19, wherein the main channel is adjacent to a periphery of the center region.

21. The plasma flat panel display of claim 20, wherein the secondary channels have openings at each end thereof, and the nonevaporable getter device is disposed within an area of the main channel that faces said openings at one end of the secondary channels.

22. The plasma flat panel display of claim 17, wherein the secondary channels have openings at each end thereof, and the nonevaporable getter device is disposed within an area of the main channel that faces said openings at one end of the secondary channels.

23. The plasma flat panel display of claim 22, wherein the nonevaporable getter device is a deposit comprised of powdered nonevaporable getter material, said deposit continuously covering the area of the main channel that faces the openings at one end of the secondary channels and having a thickness not greater than about half of the height of the main channel.

24. The plasma flat panel display of claim 23, wherein the deposit is formed directly on one of the front and rear panels.

25. The plasma flat panel display of claim 23, wherein the deposit is formed on a support member.

26. The plasma flat panel display of claim 25, wherein the support member is a metal tape.

27. The plasma flat panel display of claim 22, wherein the nonevaporable getter device is at least one pellet comprised of sintered powder of a nonevaporable getter material.

28. The plasma flat panel display of claim 27, wherein the at least one pellet is disposed in a seat formed in an inner surface of one or both of the front and rear panels.

29. The plasma flat panel display of claim 17, wherein first and second nonevaporable getter devices are disposed within the main channel.

30. The plasma flat panel display of claim 29, wherein the secondary channels have openings at each end thereof, and the first nonevaporable getter device is located within an area of the main channel that faces said openings at one end of the secondary channels and the second nonevaporable getter device is located within an area of the main channel that faces said openings at the other end of the secondary channels.

31. The plasma flat panel display of claim 17, wherein the nonevaporable getter material is selected from the group consisting of titanium, zirconium, titanium alloys containing a transition metal or aluminum, zirconium alloys containing a transition metal or aluminum, a mixture of titanium and a titanium alloy containing a transition metal or aluminum, and a mixture of zirconium and a zirconium alloy containing a transition metal or aluminum, and the nonevaporable getter material is in powder form having a particle size smaller than about 0.15 mm.

32. The plasma flat panel display of claim 31, wherein the nonevaporable getter material powder has a particle size smaller than about 128 $\mu$m.

33. The plasma flat panel display of claim 31, wherein the nonevaporable getter material powder has a particle size smaller than about 60 $\mu$m.

34. The plasma flat panel display of claim 31, wherein the nonevaporable getter material comprises an alloy selected from the group consisting of an alloy containing 70 wt % of Zr, 24.6 wt % of V, and 5.4 wt % of Fe, an alloy containing 84 wt % of Zr and 16 wt % of Al, an alloy containing 76.5 wt % of Zr and 23.5 wt % of Fe, and an alloy containing 76 wt % of Zr and 24 wt % of Ni.

35. The getter system of claim 31, wherein the nonevaporable getter material comprises a mixture containing 40 wt % of Zr and 60 wt % of an alloy containing 70 wt % of Zr, 24.6 wt % of V, and 5.4 wt % of Fe.

* * * * *